US005645247A

United States Patent [19]

Voigt

[11] Patent Number: 5,645,247

[45] Date of Patent: Jul. 8, 1997

[54] BOBBIN POST COP LOCKING MECHANISM

[75] Inventor: Richard C. Voigt, Akron, Ohio

[73] Assignee: Karg Corporation, Tallmadge, Ohio

[21] Appl. No.: 601,796

[22] Filed: Feb. 15, 1996

[51] Int. Cl.[6] ..... B65H 75/24; B65H 49/26; B65H 79/00

[52] U.S. Cl. ..... 242/597.3; 242/597.6; 242/571.5; 242/46.6; 242/130.4

[58] Field of Search ..... 242/571.4, 571.5, 242/575, 597.3, 597.6, 46.4, 46.6, 46.2, 130.4, 131

[56] References Cited

U.S. PATENT DOCUMENTS

| | | | |
|---|---|---|---|
| 146,756 | 1/1874 | Draper . | |
| 284,429 | 9/1883 | Jaquith . | |
| 505,507 | 9/1893 | Buttrick . | |
| 769,675 | 9/1904 | Allen . | |
| 1,078,393 | 11/1913 | Wardwell et al. . | |
| 1,261,356 | 4/1918 | Brown . | |
| 1,317,545 | 9/1919 | Brink . | |
| 1,341,479 | 5/1920 | Proulx . | |
| 1,805,495 | 5/1931 | McKean . | |
| 1,825,822 | 10/1931 | Rundell | 242/571.5 |
| 2,171,648 | 9/1939 | Ennis et al. | 242/597.3 |
| 2,622,818 | 12/1952 | Faris et al. | 242/46.2 |
| 2,681,189 | 6/1954 | Huber . | |
| 3,093,332 | 6/1963 | Jackson . | |
| 3,302,384 | 2/1967 | Smith et al. . | |
| 3,484,052 | 12/1969 | Clarke | 242/597.3 X |
| 3,502,279 | 3/1970 | Bundschuh et al. | 242/597.3 |
| 3,756,523 | 9/1973 | De Young | 242/46.6 |
| 3,944,153 | 3/1976 | Linker | 242/597.3 |
| 4,235,389 | 11/1980 | Ness | 242/571.5 |

*Primary Examiner*—Michael Mansen

*Attorney, Agent, or Firm*—Renner, Kenner, Greive, Bobak, Taylor & Weber

[57] ABSTRACT

A bobbin post locking mechanism (30) for selectively operatively retaining a cop (C) having a throughbore (C') on a bobbin post spindle (15) including, a cylindrical post (20) fixedly mounted on a spindle, a bore (21) in the cylindrical post, an axially extending cutout (26) in the cylindrical post communicating with the bore, and a lever mechanism (40) supported within the bore mounted to move radially outwardly of the cylindrical post for engaging the throughbore of the cop to preclude relative rotation and axial displacement of the cop relative to the cylindrical post.

18 Claims, 3 Drawing Sheets

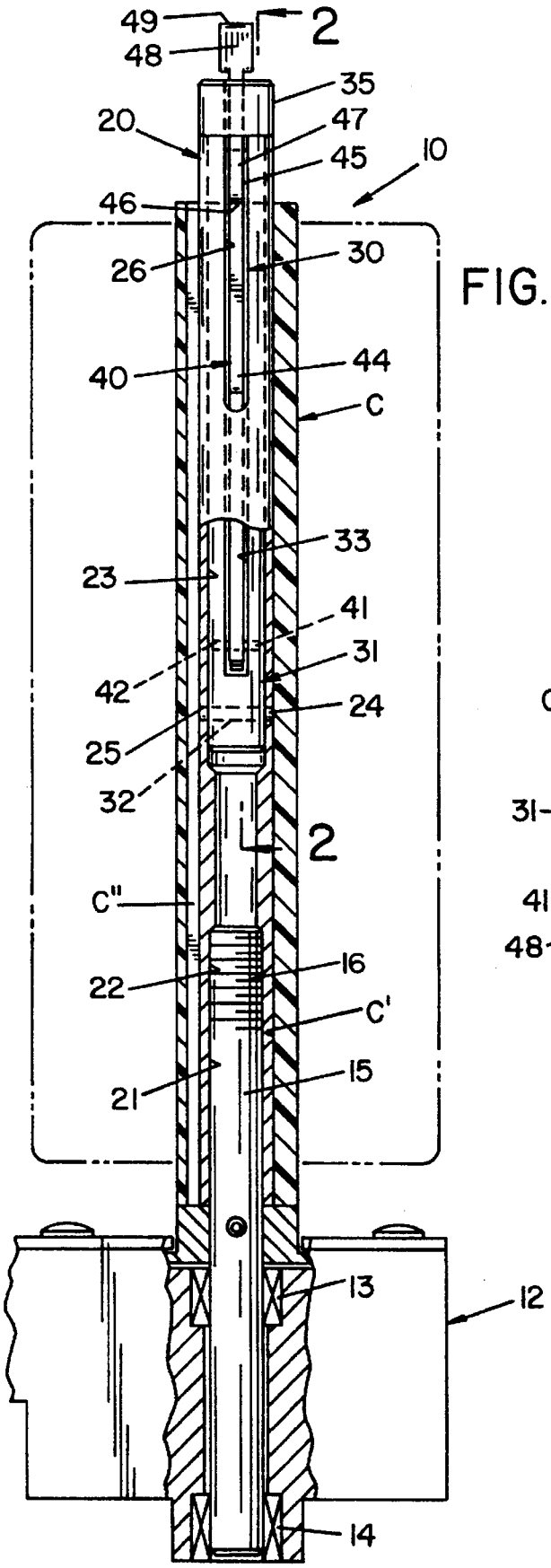
FIG. 1
FIG. 3
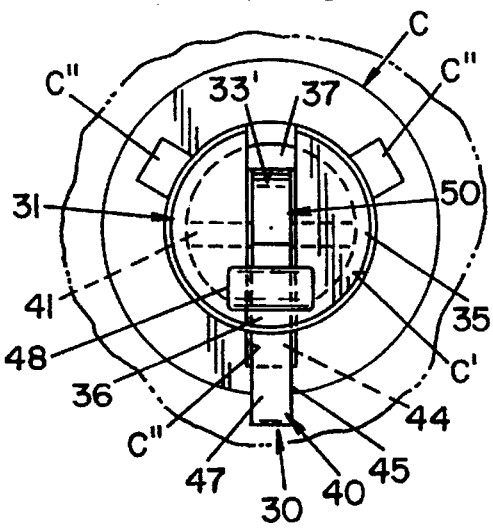

BOBBIN POST COP LOCKING MECHANISM

TECHNICAL FIELD

The present invention relates generally to a bobbin post for strand fabricating or braiding machines or the like. More particularly, the present invention relates to a bobbin post for mounting a cop or tube on which stranding of thread, yarn, or roving is wound for payout in a controlled manner. More specifically, the present invention relates to a lock mechanism for a bobbin post which provides for ease of mounting and demounting of a cop therefrom while effecting axial and rotational restraint of the cop relative to the bobbin post while positioned thereon.

BACKGROUND ART

Various types of strand fabricating, braiding machines, or the like have been known for many years. Machines of this type have in common the use in different arrangements of a plurality of bobbin posts for mounting a cop or tube on which stranding of thread, yarn, or roving of various types of natural or synthetic materials are wound for payout in a controlled manner during operation of the machinery. Characteristically, the bobbin posts are mounted on and non-rotatably attached to a freely-rotatably mounted spindle for effecting payout of the stranding wound on the cop in a controlled manner. Over the years, many devices have been employed to effect retention of a cop on a bobbin post, such as to allow demounting and mounting of a cop with respect to a bobbin post when the strand material on the cop is exhausted or when a cop having a full supply of strand material is to be loaded, respectively.

For many years, cop locking mechanisms were commonly in the form of a plurality of circumferentially-spaced spring members which normally define a circumference greater than the diameter of the central bore of a mating cop. When the cop bore was inserted over the springs of the bobbin posts, the springs collapsed to maintain a strong frictional engagement with the bore of the cop. In many instances, it was difficult to achieve a design of the springs of which there were many which would maintain the cops in the precise position required on the bobbin posts during the operating motions of strand fabricating or braiding machines. In addition, the springs would frequently exhibit wear characteristics due to the highly repetitious mounting and demounting of cops incident to operation of the machines, such that the cops were not appropriately axially restrained on the bobbin posts and would become axially displaced during operation of the machines. Efforts have been made to design somewhat oversized or over-tensioned springs to preclude axial release of the cops during operation of the machines. However, these designs commonly required the machine operator to exert extreme amounts of force in order to effect the mounting and demounting of cops, thus having detrimental effects on the production rates of machines having bobbin posts with such spring constructions.

Until relatively recently, cops for strand materials have normally been constructed of cardboard or similar materials which can be depressed or cut relatively easily. As a result, many current designs have employed a type of spring steel having some type of blade configuration that is designed to dig into the cop in the bore area to enhance retention of the cop on a bobbin post provided with such biased blades. Devices of this type continue to suffer the disadvantage that it is often difficult in terms of exerting large forces to mount and demount the cops on bobbin posts having such locking mechanisms. While bobbin posts having such blade mechanisms are often effective to prevent relative rotation between the bobbin posts and the cop, some of such blade designs are not effective to prevent axial movement of a cop relative to a bobbin post having such a blade configuration. As a result, many of the designs employing such a spring blade also require a second, separate latch mechanism which is actuated to prevent the cop from being displaced axially of the bobbin post. Such latch mechanisms frequently take the form of a bar mounted at the axially outer extremity of the bobbin post, which is pivotal between a position aligned with the post for receiving a cop as an open position to a closed position effected by rotating the bar through 90°, such that it resides perpendicular to the bobbin post just axially outwardly of the cop when it is in the operating position on the bobbin post. Such latch mechanisms have the disadvantage of requiring a second operation by a machine operator in both mounting and demounting cops on the bobbin post, as well as independent verification that the latch is open when a cop is to be mounted and that the latch is locked upon mounting a cop before actuation of the machine.

Due to the disadvantages of the aforedescribed springs, leaves, and blades, some current designs have employed a plurality of projecting circumferentially-spaced fixed drive keys extending longitudinally of the bobbin posts, which are engaged by specially designed cops which have a plurality of mating circumferentially-spaced longitudinal grooves within the throughbore of the cop. While these key drives do provide positive rotational interaction between the cop and the bobbin post, they do require that the machine operator take additional time to grasp the bobbin post and restrain it while the cop grooves are aligned with the bobbin post keys before the cops can be mounted on the bobbin posts. These fixed key drive designs also require a separate latch mechanism to secure the cop axially of the bobbin post.

Summarily, existing and prior cop locking mechanisms have suffered either operational shortcomings or have required excessive operator time and manipulation to effect mounting and demounting of cops on bobbin posts. As a result, none of the existing designs have achieved widespread acceptance in the industry.

DISCLOSURE OF THE INVENTION

Therefore, an object of the present invention is to provide a bobbin post cop lock mechanism wherein a single latch mechanism operates to both preclude relative rotation between the bobbin post and a cop and axial displacement of the cop relative to the bobbin post. Another object of the present invention is to provide such a locking mechanism which provides positive rotational coupling of the bobbin post and the cop by the use of a spline on the bobbin post which engages a groove in the throughbore of the cop. A further object of the present invention is to provide such a locking mechanism wherein the latch on the bobbin post fully disengages the cop, whereby the cop may be removed from the bobbin post virtually effortlessly and without the necessity of manually overcoming retentive forces imparted by a blade or the like.

Another object of the present invention is to provide a locking mechanism for operatively retaining a cop on a bobbin post wherein a lever associated with the bobbin post which when engaged positively overlies an end of a cop in a manner precluding axial movement of the cop from the fully seated position on the bobbin post. Another object of the invention is to provide such a locking mechanism which includes a catch for axially restraining the cop with a tapered surface on the lever leading to the catch which automatically depresses the lever when a cop is pushed onto the bobbin post without the necessity for an operator manually opening or otherwise actuating the lever. A further object of the present invention is to provide such a locking mechanism wherein the lever cannot be left in an open position that precludes the mounting of a cop on a bobbin post without action by a machine operator. Still another object of the present invention is to provide such a locking mechanism wherein the cop may be started on the bobbin post at any random relative circumferential orientation between the projecting spline of the bobbin post lever and the grooves in the cop, with the cop being subsequently rotatable relative to the bobbin post until such time as the spline aligns with and is spring biased into an axial groove in the cop throughbore.

Still another object of the present invention is to provide a locking mechanism for retaining a cop on a bobbin post which employs a latch mechanism that can be employed in a wide variety of strand fabricating or braiding machines to achieve the aforedescribed operational advantages. Yet a further object of the present invention is to provide such a locking mechanism which assures ease of demounting the cops from a bobbin post by actuating a single readily accessible tab while assuring operational reliability of a cop mounted on a bobbin post by merely insuring that a catch on the lever is properly positioned relative to the end of the cop. Yet a further object of the present invention is to provide such a locking mechanism which is relatively compact, non-complex, and inexpensive, yet can be readily dismantled for ease of repair or replacement.

In general, the present invention contemplates a bobbin post locking mechanism for selectively operatively retaining a cop having a throughbore on a bobbin post spindle including, a cylindrical post fixedly mounted on the spindle, a bore in the cylindrical post, an axially extending cutout in the cylindrical post communicating with the bore, and a lever mechanism supported within the bore mounted to move radially outwardly of the cylindrical post for engaging the throughbore of the cop to preclude relative rotation and axial displacement of the cop relative to the cylindrical post.

BRIEF DESCRIPTION OF THE DRAWINGS

FIG. 1 is a side-elevational view of a bobbin post according to the concepts of the present invention with portions in section and portions partially broken away shown mounted on an exemplary spindle and showing an exemplary cop in chain lines positioned thereon.

FIG. 3 is a fragmentary end elevational view of the bobbin post and cop of FIG. 1 showing details of the interrelation therebetween.

PREFERRED EMBODIMENT FOR CARRYING OUT THE INVENTION

Figure 2:
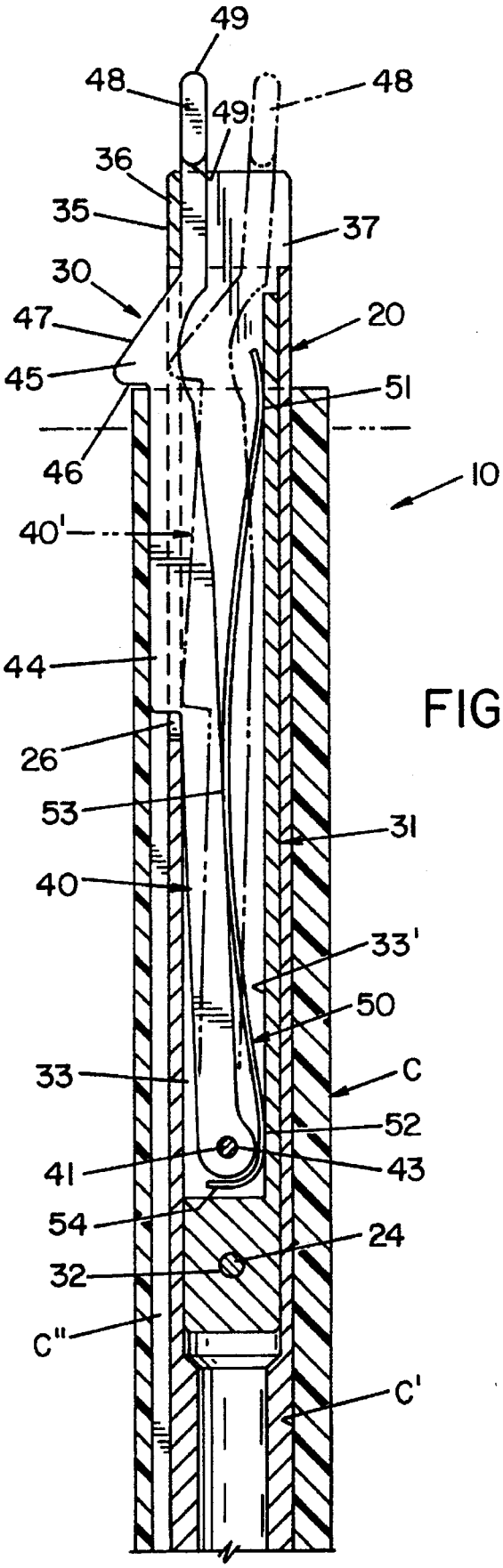
FIG. 2 is an enlarged fragmentary sectional view taken substantially along the line 2—2 of FIG. 1 showing internal structural details of the bobbin post.

A bobbin post assembly embodying the concepts of the present invention is generally indicated by the numeral 10 in FIGS. 1 and 2 of the drawings. The bobbin post 10 is shown mounted for free rotation on a spindle housing, generally indicated by the numeral 12. The spindle housing 12 internally mounts spaced bearings 13 and 14 which freely rotatably mount a spindle 15, which projects outwardly of spindle housing 12 and is preferably provided proximate its axial outward extremity with external threads 16 for a purpose to be described hereinafter.

Figure 4:
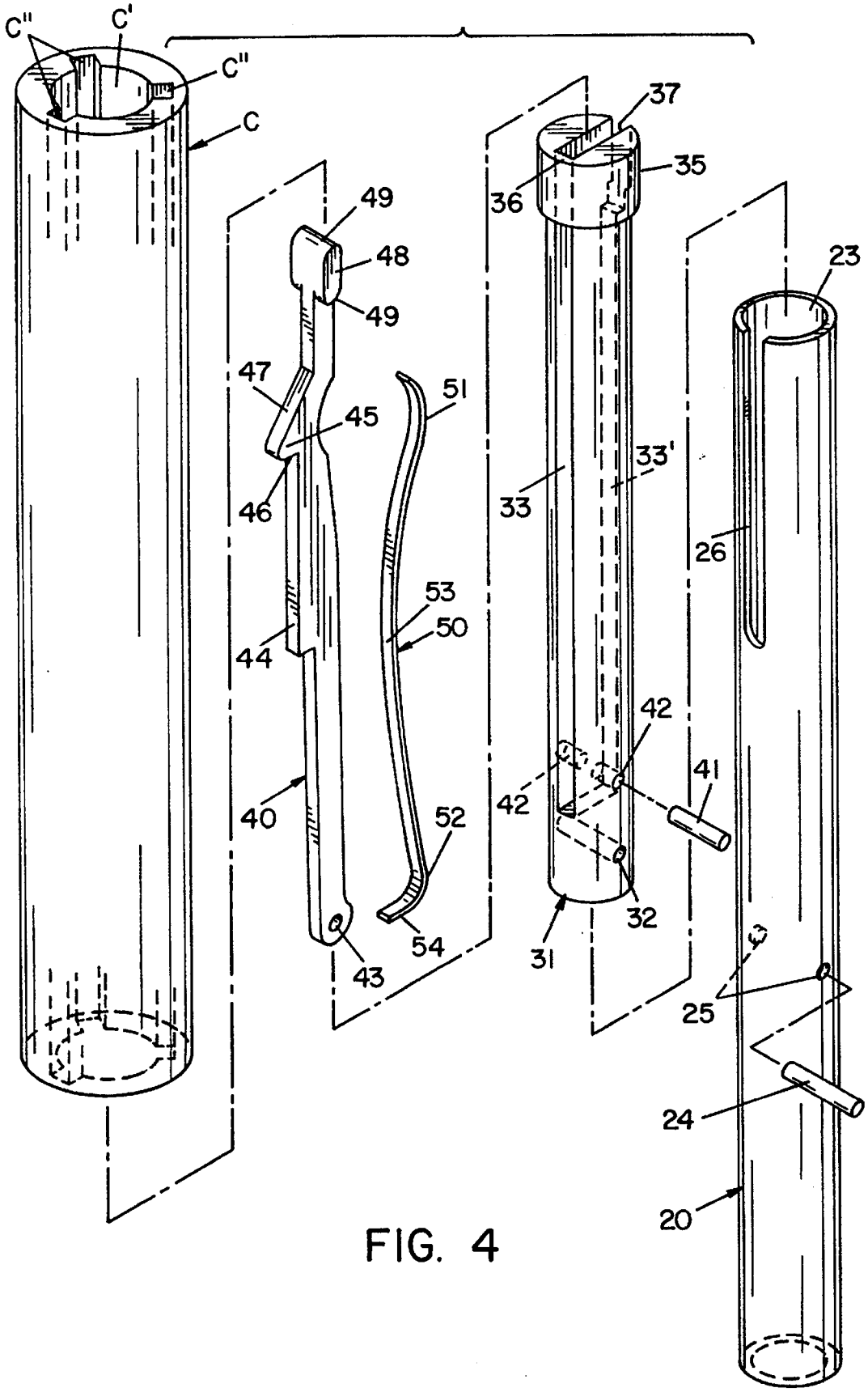
FIG. 4 is an enlarged exploded view of the bobbin post of FIG. 1 showing structural details of the components and the manner of assembly.

The bobbin post assembly 10 has as a primary structural component thereof an elongate cylindrical post, generally indicated by the numeral 20. The cylindrical post 20 is of a length and diameter such as to receive a cylindrical cop, generally indicated by the letter C. The cop C may be any of a number of conventional designs and may be constructed of cardboard, pressboard, various types of plastics, or the like. As seen in FIGS. 1, 3, and 4, the cop C has a central throughbore C' which is of substantially the same or a slightly larger diameter than the diameter of the cylindrical post 20. The precise configuration of the cop C, other than the central throughbore C' may vary in particulars well known to persons skilled in the art, with the primary requirement being to provide a generally cylindrical surface about which thread, yarn, roving, or the like is wound for uniform payout in a controlled manner in a direction generally axially of cylindrical post 20, as conventionally takes place in strand-fabricating or braiding machines. In the preferred form of the invention shown in the drawings, the cop C has at least one axial groove C" extending radially outwardly of the central throughbore C' and traversing the full axial length of the cop C. As shown in FIGS. 3 and 4 of the drawings, the cop C is provided with three axial grooves C" which are centered at substantially 120° circumferential increments within the central throughbore C'. It will be appreciated by persons skilled in the art that more or less of the grooves C" may be employed in the cop C in the practice of the instant invention.

For purposes of supporting the cylindrical post 20, the spindle 15 extends into a cylindrical bore 21 in one end of cylindrical post 20. The cylindrical bore 21 has internal threads 22 over a portion of its axial extent which matingly engage the threads 16 at the axial extremity of the spindle 15. It will thus be appreciated that cylindrical post 20 may be readily mounted on or remounted from the spindle 15 by threading engagement therewith. Thus, cylindrical post 20 is selectively nonrotatably affixed to and positioned for free rotation with the spindle 15 in the bearings 13, 14.

A cop C may be selectively mounted on, retained, and demounted from bobbin post assembly 10 through the operation of a cop locking mechanism, generally indicated by the numeral 30 in FIGS. 1 and 2 of the drawings. The locking mechanism 30 interrelates with cylindrical post 20 largely through a carrier, generally indicated by the numeral 31, as best seen in FIGS. 2 and 4. The carrier 31 reposes in a cylindrical bore 23 in cylindrical post 20 at the end thereof opposite the cylindrical bore 21. The carrier 31 is axially and rotationally fixed within cylindrical bore 23 of cylindrical post 20 by a pin 24 which extends through a radial bore 25 in cylindrical post 20 and a radial bore 32 in carrier 31. It will, of course, be appreciated that the entire carrier 31 may be removed and, if desired, replaced merely by removal of the pin 24.

The carrier 31 is a generally solid cylindrical member having a rectangular slot 33 which extends axially a substantial portion of the length of the carrier 31 and is of a substantial radial depth which, as shown, is somewhat in excess of the radius of the carrier 31. As seen in FIGS. 1 and 2, the carrier 31 extends a distance axially outwardly of the cylinder post 22 at the axial extremity opposite the spindle 15 where an enlarged cap 35 is preferably integrally formed as a part of the carrier 31. As best seen in FIGS. 2 and 4, the cap 35 may be of a slightly enlarged cylindrical configuration relative to the remainder of the carrier 31, with a continuous sector 36 terminating the slot 33. The cap 35 is discontinuous at a circumferential location displaced substantially 180° from the continuous sector 36 where a notch 37 is cut radially inwardly through a substantial portion of cap 35. The notch 37 is preferably substantially sized and aligned to constitute a continuation of the rectangular slot 33 except for the continuous sector 36, which operates as a stop in a manner described hereinafter.

The rectangular slot 33 and notch 37 of carrier 31 house a lever, generally indicated by the numeral 40. As shown, the lever 40 is a generally flat, elongate member which is of a thickness slightly less than the width of slot 33 and notch 37, such that it is readily seated within and guided thereby while permitting free radial movement of lever 40 with respect thereto. The lever 40 is pivotally positioned within slot 33 and notch 37 by a pivot pin 41 which extends through an axial bore 42 in carrier 31 in the area of rectangular slot 33 and through an aperture 43 preferably proximate one end of lever 40. The lever 40 has a projecting spline 44 spaced a distance from the aperture 43 and directed outwardly of the slot 33. As best seen in FIGS. 2 and 4, the projecting spline 44 is positioned in slot 33 such that it can extend radially outwardly of rectangular slot 33 and through an axial cutout 26 in the cylindrical post 20 when rotated about pivot pin 41. As can be seen in FIG. 2, the lever 40 is restrained as to the extent of radial outward movement with respect to rectangular slot 33 by cylindrical post 20 and the continuous sector 36 of cap 35 which operates as a stop.

The lever 40 also has a radially extending catch 45 which constitutes a further extension of lever 40 radially outwardly of the spline 44. As shown, the catch 45 has a substantially radial surface 46 which is adapted to engage the axial end of a cop C when the lever 40 is in the solid line position depicted in FIG. 2 to prevent axial displacement of the cop off of the cylindrical post 20. The catch 45 also has a tapered ramp 47 extending radially inwardly and axially outwardly of cylindrical post 20 from the radial outer extremity of radial surface 46.

The extremity of the lever 40 opposite the aperture 43 has a tab 48. As shown, the tab 48 has a greater width than the thickness of lever 40 and has rounded extremities 49. This configuration facilitates manual actuation by a machine operator of tab 48 to selectively move the lever 40 while reducing the possibilities of inadvertent injury to the operator.

The lever 40 is normally pivotally biased to the solid line position depicted in FIG. 2 of the drawings by a spring, generally indicated by the numeral 50. As best seen in FIGS. 2 and 4, the spring 50 is of a generally elongated W-shaped leaf configuration. The two spaced curvilinear end contact areas 51 and 52 of spring 50 are positioned so as to engage a bottom surface 33' of the rectangular slot 33. Spring 50 also has an oppositely curved intermediate contact area 53 which engages the lever 40 preferably substantially medially thereof. It will thus be appreciated, particularly from viewing FIG. 2, that spring 50 engages the underside of lever 40 and biases it outwardly to the solid line position depicted. The extremity of spring 50 proximate the end contact area 52 forms an upturned flange 54. As can be seen in FIG. 2, the end of lever 40 proximate the pin 41 is located and contoured such that the flange 54 is captured by the slot 33 and lever 40 in the position depicted in FIG. 2 once spring 50 and lever 40 are positioned as depicted in FIG. 2 and pin 41 is installed as shown.

While operation of the locking mechanism 30 of cylindrical post 20 is largely self-evident from the preceding description, several advantageous operating results should be particularly appreciated. The locking mechanism 30, with the lever 40 in the solid line position of FIG. 2, is shown retaining a cop C in the mounted operating position. The projecting spline 44 is engaged in one of the axial grooves C" in the central throughbore C' of a cop C to thereby preclude relative rotation between cop C and the cylindrical post 20. The radial surface 46 of catch 45 of lever 40 radially overlies the end of cop C, thereby precluding axial displacement of the cop C outwardly of or off of the cylindrical post 20.

When the strand material has been depleted from a cop C, it is possible to readily remove the cop C from the cylindrical post 20 by an operator depressing the tab 48 of lever 40 against the biasing of spring 50 to the chain line position 40' depicted in FIG. 2, at which time the empty cop C may be grasped and removed axially of cylindrical post 20 essentially without obstruction or resistance. It will be appreciated that after the initial movement of the cop C, it maintains the lever 40 in the depressed chain line position 40' until the cop C clears the cylindrical post 20, at which time the lever 40 is biased back to its normal solid line position 40 of FIG. 2 by the spring 50.

Immediately upon removal of an empty or used cop C, a fresh cop C may be mounted on cylindrical post 20. In that respect, an operator need only align a new cop C with post 20 and push inwardly relative to cylindrical post 20, with the locking mechanism 30 being automatically retracted by introduction of the cop C. In particular, the central throughbore C' of the cop C engages the tapered ramp 47 of catch 45 and depresses lever 40 to the chain line position 40' depicted in FIG. 2 against the biasing force of spring 50. As soon as C is positioned on cylindrical post 20 so that its end passes catch 45 of lever 40, the spring 50 biases lever 40 outwardly, thereby axially locking cop C on cylindrical post 20. If such is not the case, the cop C is then rotated relative to cylindrical post 20 until projecting spline 44 engages one of the axial grooves C" in cop C, at which time lever 40 assumes the axially and rotationally locked position of cop C relative to cylindrical post 20, as depicted in the solid line position of lever 40 in FIG. 2 of the drawings.

Thus, it should be evident that the subject bobbin post cop lock mechanism carries out the various objects of the invention set forth hereinabove and otherwise constitutes an advantageous contribution to the art. As may be apparent to persons skilled in the art, modifications can be made to the preferred embodiment disclosed herein without departing from the spirit of the invention, the scope of the invention being limited solely by the scope of the attached claims.

I claim:

1. A bobbin post locking mechanism for selectively operatively retaining a cop having a throughbore on a bobbin post spindle comprising, a cylindrical post fixedly mounted on the spindle, a bore in said cylindrical post, an axially extending cutout in said cylindrical post communicating with said bore, a carrier mounted in said bore in said cylindrical post, and a lever mechanism housed in said carrier mounted to move radially outwardly of said cylindrical post for engaging the throughbore of the cop to preclude relative rotation and axial displacement of the cop relative to said cylindrical post.

2. A bobbin post locking mechanism according to claim 1, wherein said lever mechanism has a projecting spline for engaging the throughbore of the cop to preclude relative rotation.

3. A bobbin post locking mechanism according to claim 1, wherein said lever mechanism has a projecting catch for axially restraining the cop.

4. A bobbin post locking mechanism according to claim 1, wherein said carrier has an axially extending slot cooperatively aligned with said cutout in said cylindrical post through which said lever mechanism projects for moving radially outwardly of said cylindrical post.

5. A bobbin post locking mechanism according to claim 4, wherein said carrier has an end cap with a radial notch aligned with said slot through which said lever mechanism axially projects and said lever mechanism has a tab for manual actuation thereof.

6. A bobbin post locking mechanism according to claim 4, wherein a pin maintains said carrier axially and rotationally fixed in said bore in said cylindrical post with said slot aligned with said cutout.

7. A bobbin post locking mechanism according to claim 4, wherein a pivot pin supported by said carrier mounts said lever mechanism for movement.

8. A bobbin post locking mechanism according to claim 7, wherein a spring biases said lever mechanism radially outwardly of said cylindrical post.

9. A bobbin post locking mechanism according to claim 8, wherein said spring is interposed between said slot in said carrier and said lever mechanism.

10. A locking mechanism for operatively retaining a cop on a bobbin post having an axially extending cutout and a bore communicating with the cutout comprising, a carrier positioned in the bore of the bobbin post, an axial slot in said carrier cooperatively aligned with the cutout in the bobbin post, and a lever mechanism in said axial slot mounted to move radially outwardly of said carrier and the bobbin post for engaging the cop to preclude relative rotation and axial displacement of the cop relative to the bobbin post.

11. A locking mechanism according to claim 10, wherein a pin pivotally mounts said lever mechanism in said axial slot.

12. A locking mechanism according to claim 11, wherein a spring biases said lever mechanism to normally extend radially outwardly of the bobbin post into engagement with the cop.

13. A locking mechanism according to claim 14, wherein a leaf spring underlying said lever mechanism in said axial slot pivotally biases said lever to project radially outwardly through said cutout in the bobbin post into engagement with the cop.

14. A locking mechanism according to claim 11, wherein said lever mechanism has a projecting spline for engaging said cop.

15. A locking mechanism according to claim 11, wherein said lever mechanism has a projecting catch for axially restraining the cop.

16. A locking mechanism according to claim 15, wherein said lever mechanism has a tab projecting axially outwardly of said catch and the bobbin post, whereby actuation of said tab moves said lever radially inwardly for releasing the cop from said catch to permit demounting of the cop from the bobbin post.

17. A locking mechanism according to claim 15, wherein said catch has a substantially radial surface for restraining the cop and a tapered ramp for engaging the bore of the cop to radially depress said lever mechanism when mounting the cop on the bobbin post.

18. A locking mechanism according to claim 10, wherein said carrier has a cap including a stop limiting the extent of movement of said lever mechanism radially outwardly of the bobbin post.

* * * * *

UNITED STATES PATENT AND TRADEMARK OFFICE

CERTIFICATE OF CORRECTION

PATENT NO. : 5,645,247

DATED : July 8, 1997

INVENTOR(S) : Richard C. Voigt

It is certified that error appears in the above-indentified patent and that said Letters Patent is hereby corrected as shown below:

Column 8, line 5, "claim 14" should read –claim 11–.

Signed and Sealed this

Fifth Day of May, 1998

*Attest:*

*Attesting Officer*

BRUCE LEHMAN

*Commissioner of Patents and Trademarks*